US011497976B2

(12) United States Patent
Cheng

(10) Patent No.: US 11,497,976 B2
(45) Date of Patent: Nov. 15, 2022

(54) GOLF BAG SUPPORTING MECHANISM

(71) Applicant: BIN LUNE ENTERPRISE CO., LTD., Miaoli County (TW)

(72) Inventor: Kai-Lun Cheng, Miaoli County (TW)

(73) Assignee: BIN LUNE ENTERPRISE CO., LTD., Miaoli County (TW)

( * ) Notice: Subject to any disclaimer, the term of this patent is extended or adjusted under 35 U.S.C. 154(b) by 0 days.

(21) Appl. No.: 17/151,754

(22) Filed: Jan. 19, 2021

(65) Prior Publication Data

US 2022/0226706 A1 Jul. 21, 2022

(51) Int. Cl.
*A63B 55/50* (2015.01)

(52) U.S. Cl.
CPC ..... *A63B 55/50* (2015.10)

(58) Field of Classification Search
CPC ..... A63B 55/50; A63B 55/57; A63B 55/00
See application file for complete search history.

(56) References Cited

U.S. PATENT DOCUMENTS 5,156,366 A * 10/1992 Anderson ..... A63B 55/57 248/96
6,098,797 A * 8/2000 Han ..... A63B 55/57 206/315.7
6,311,938 B1 * 11/2001 Lin ..... A63B 55/53 248/96
6,315,117 B1 * 11/2001 Han ..... A63B 55/53 206/315.3
6,435,345 B1 * 8/2002 Wang ..... A63B 55/50 206/315.7
6,494,416 B2 * 12/2002 Wang ..... A63B 55/53 248/96
8,919,548 B2 * 12/2014 McGuire ..... A63B 55/53 206/315.7

* cited by examiner

*Primary Examiner* — Kimberly T Wood

(74) *Attorney, Agent, or Firm* — Demian K. Jackson; Jackson IPG PLLC

(57) ABSTRACT

A golf bag includes a bag body, a head frame, a chassis and a supporting mechanism. The supporting mechanism is configured on one side of the bag body, comprising two support bars and two elastic bars. One end of the two support bars is pivoted on the head frame. The two elastic bars are relatively pivoted between the chassis and the two connecting blocks configured on the two support bars. It is characterized in that: the supporting mechanism further comprises two limiting members, respectively configured at the pivoting position of the two support bars and the two elastic bars, to limit the pivoting position of the two support bars and the two elastic bars.

8 Claims, 6 Drawing Sheets

GOLF BAG SUPPORTING MECHANISM

BACKGROUND OF INVENTION

1. Field of the Invention

The present invention relates generally to a golf bag, and more particularly to an improved golf bag supporting mechanism.

2. Description of Related Art

In a conventional golf bag, the supporting structure is configured on one side of the bag body to prop up the golf bag on the ground, and is consisted of two support bars. One end of the two support bars is pivoted on the head frame at the top side of the bag, and two elastic bars, being metal bars, are relatively pivoted between the chassis at the bottom side of the bag body and the two connecting blocks configured on the two support bars. A fastening member, connected between the two elastic bars, can generate a force for the two elastic bars to pull the two support bars, preventing the two support bars to stretch outward freely. When the two support bars stretch out, they can prop up the bag body on the ground. The two support bars can also be folded on one side of the bag body.

Furthermore, the bag body of a golf bag is usually configured with a back strap on one side, for the user to carry the golf bag on the back. When the user carries the golf bag, the bag body will endure the pressure from the weight of the articles filled inside the bag. Because a plurality of frame bars are configured inside the bag body to connect the head frame to the chassis, the head frame, the chassis and the frame bars can offer an appropriate rigidity. Under normal conditions of use, the golf bag will not deform when it is filled with many golf clubs. However, when a user carries a golf bag filled with too many golf clubs, the construction of the head frame, the chassis and the frame bars may have a slight deformation, resulting in the deformation of the two elastic bars, and consequently causing automatic outstretch of the two support bars. This not only affects the neat appearance, but also poses a risk that the outstretching support bars may poke and hurt others.

However, in the existing golf bags, there is still no such structures or designs to avoid this problem.

SUMMARY OF THE INVENTION

The main object of the present invention is to provide an improved golf bag supporting mechanism, which can solve the problem that the two support bars will automatically stretch out when the golf bag carried by the user is filled with too many things. It is of great practical value.

In order to accomplish the above object, the present invention provides an improved golf bag supporting mechanism. The golf bag comprises a bag body having an upward opening. The top end and bottom end of the bag body are respectively configured with a head frame and a chassis. The supporting mechanism is configured on one side of the bag body, comprising two support bars and two elastic bars. One end of each of the two support bars is pivoted on the head frame. The two elastic bars are relatively pivoted between the chassis and the two connecting blocks configured on the two support bars. The invention is characterized in that: the supporting mechanism further comprises two limiting members, respectively configured at the pivoting position of the two support bars and the two elastic bars, to limit the pivoting position of the two support bars and the two elastic bars. Users need to apply a force to pull the two support bars outward, so that the two support bars and the two elastic bars can be released from the two limiting members and be able to pivot in relation to each other, and the two support bars can smoothly stretch out.

BRIEF DESCRIPTION OF THE DRAWINGS

Further detailed descriptions are provided below with respect to a preferred embodiment of the invention, and with reference to the accompanying drawings.

DETAILED DESCRIPTION OF THE INVENTION

Figure 1:
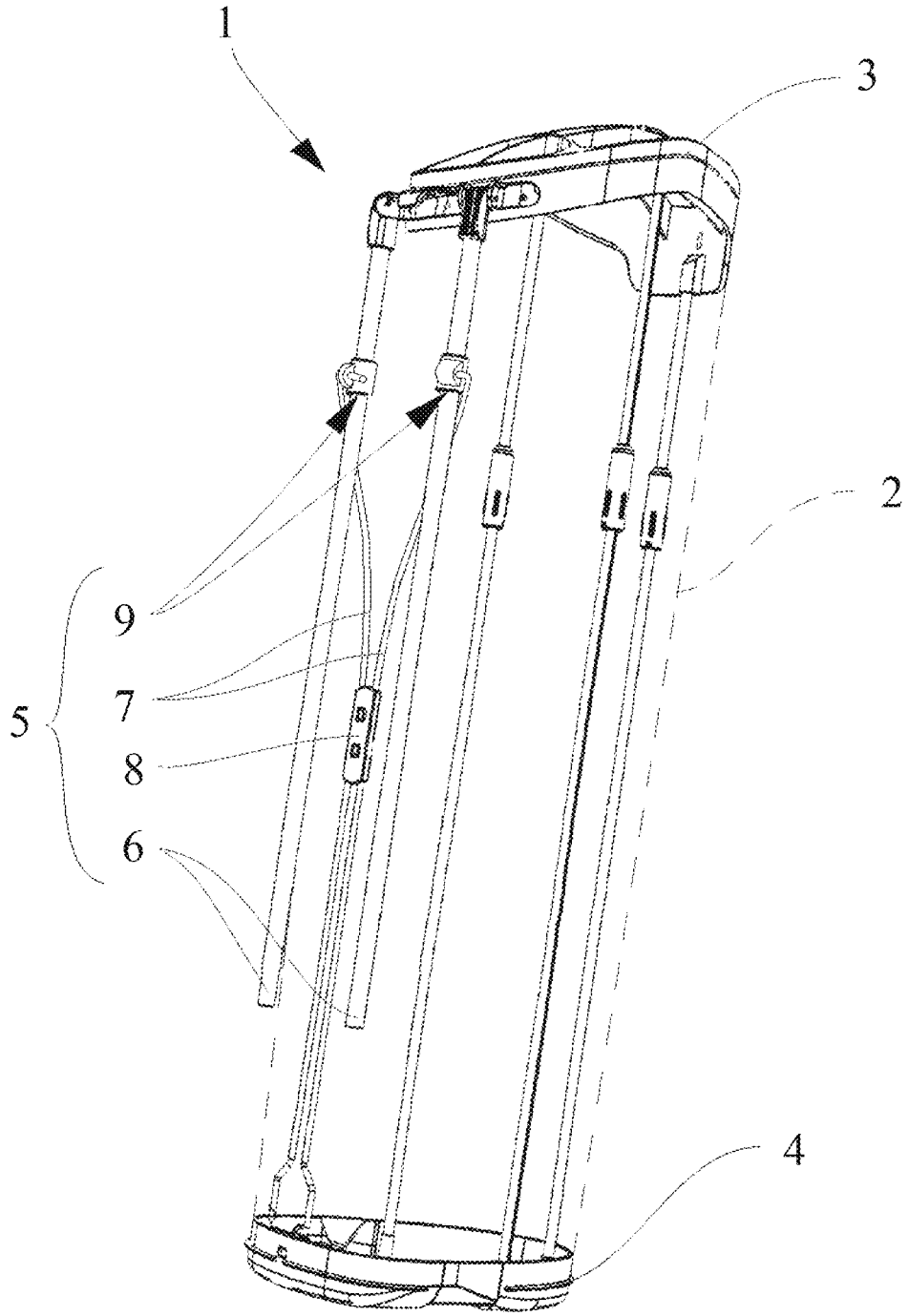
FIG. 1 is a combined perspective view of a preferred embodiment of the invention.
Figure 2:
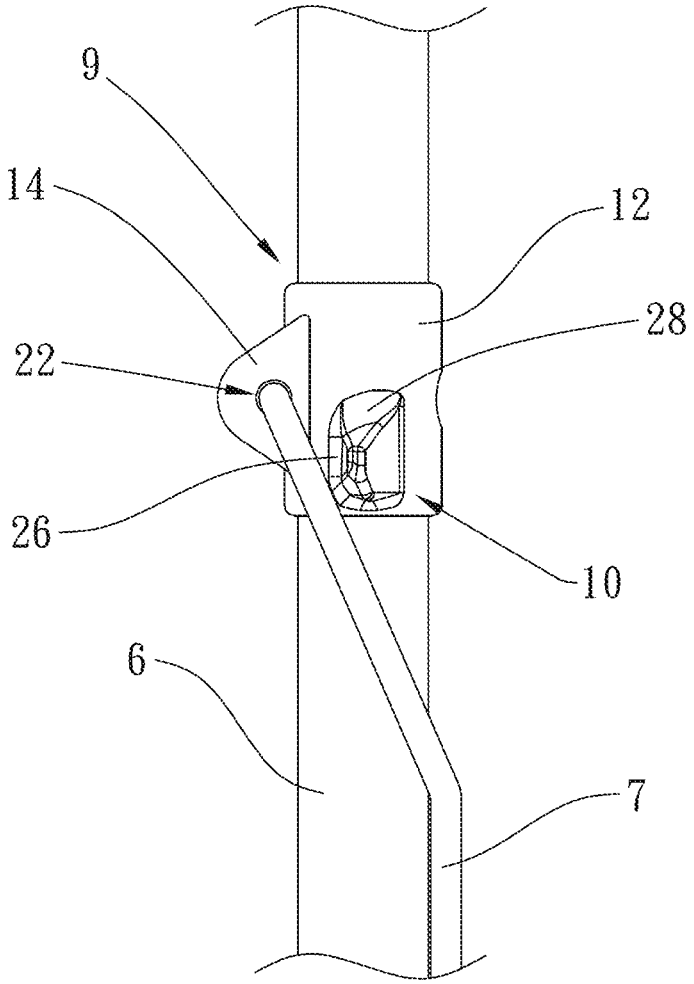
FIG. 2 is a partial side view of the support bars, elastic bars, and limiting members of a preferred embodiment of the invention.
Figure 3:
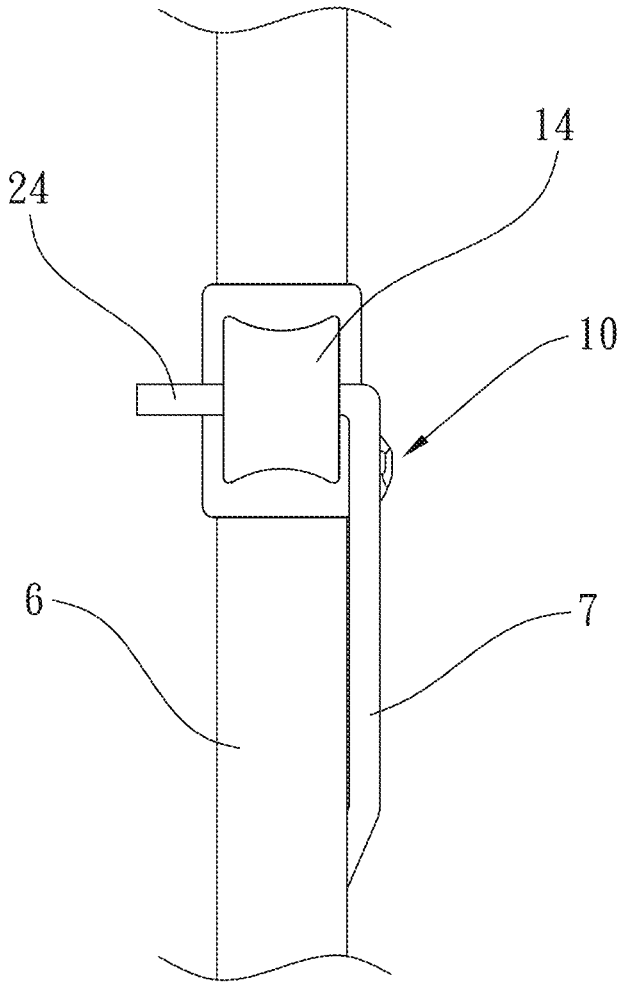
FIG. 3 is a partial front view of the support bars, elastic bars, and limiting members of a preferred embodiment of the invention.

Referring to FIG. 1 to FIG. 3, a preferred embodiment of a supporting mechanism of a golf bag according to the invention is depicted. The golf bag 1 comprises a bag body 2, a head frame 3, a chassis 4 and a supporting mechanism 5. The bag body 2 is in the form of an enclosure having an upward opening. The head frame 3 and the chassis 4 are respectively configured on the top end and bottom end of the bag body. The supporting mechanism 5 is configured on one side of the bag body 2, comprising two support bars 6, two elastic bars 7 and a fastening member 8. One end of each of the two support bars 6 is pivoted on the head frame 3. The two elastic bars 7 are metal bars, relatively pivoted between the chassis 4 and the two connecting blocks 9 configured on the two support bars 6. The fastening member 8 is connected between the two elastic bars 7. The two support bars 6 can relatively stretch outward in relation to the bag body 2 to prop up the bag body 2 on the ground, or be folded on one side of the bag body 2. Said bag body 2, head frame 3, chassis 4 and the support bars 6, the elastic bars 7, and the fastening member 8 of the supporting mechanism 5 are all conventional components of a golf bag, and are therefore not detailed herein. The features of the present invention are as follows:

The supporting mechanism 5 further comprises two limiting members 10, respectively configured at the pivoting position of the two support bars 6 and the two elastic bars 7, capable of limiting the pivoting position of the two support bars 6 and the two elastic bars 7, so that the two support bars 6 and the two elastic bars 7 cannot easily pivot in relation to each other. Users need to apply a force to pull the two support bars 6 outward, so that the two support bars 6 and the two elastic bars 7 can be released from the two limiting members 10 and pivot in relation to each other, and the two support bars 6 can smoothly stretch outward.

In detail, the two connecting blocks 9 respectively comprise a sleeve body 12, a pivoting block 14 and a limiting member 10. Each of the sleeve body 12 is in the shape of a tube, respectively sleeved on the two support bars 6. Each of the pivoting block 14 and limiting members 10 are relatively configured on the outside of the sleeve body 12 in a protruding form, and each of the pivoting blocks 14 is located at a position outside the sleeve body 12 away from the bag body 2. Each of the pivoting blocks 14 are respectively configured with a through hole 22. The two through holes 22 extend in the direction parallel to the head frame 3 and the chassis 4. The top end of each of the two elastic bars 7 is respectively bent to form a bent segment 24. Each of the bent segments 24 is inserted into each of the two through holes 22 from the outside of the two support bars 6 in relation to each other. The bent portion of the top end of each of the two elastic bars 7 is located outside each of the through holes 22. The inner diameter of each of the through holes 22 is larger than the outer diameter of each of the bent segments 24, so that each of the bent segments 24 can rotate or move inside each of the through holes 22. Each of the limiting members 10 is roughly in a pointed shape, respectively configured outside the sleeve body 12 in a protruding form and corresponding to the two elastic bars 7, and is respectively configured with a blocking plane 26 and a guide plane 28. Each of the blocking planes 26 and guide planes 28 extends along the surface of the surface of each of the limiting members 10 in a tilted form. Each of the blocking planes 26 is located at one end of each of the two limiting members 10 corresponding to the two elastic bars 7, to push against the two elastic bars 7, so that the two support bars 6 cannot pivot in relation to the two elastic bars 7.

Thus, when the two support bars 6 are not pulled outward, they are folded on one side of the bag body 2. At this time, the two elastic bars 7 are pushed against the blocking planes 26 of the two limiting members 10. Due to the limitation from the two blocking planes 26 blocking the two elastic bars 7, a resistance is generated to prevent the two support bars 6 from rotating around the pivot in relation to the two elastic bars 7. As a result, when the golf bag 1 is carried by the user, the two support bars will no longer stretch out automatically when the golf bag is filled with too many things, as is the case with the prior-art golf bag.

Figure 4:
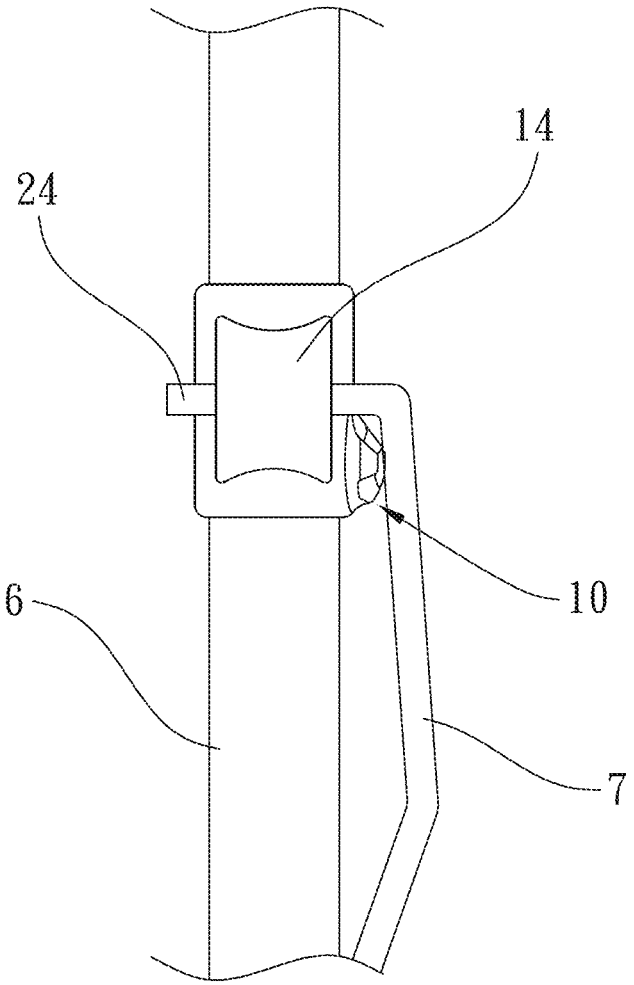
FIG. 4 is a schematic diagram showing the movement of the bent segment, and the elastic bars located on the outer end of the limiting members.
Figure 5:
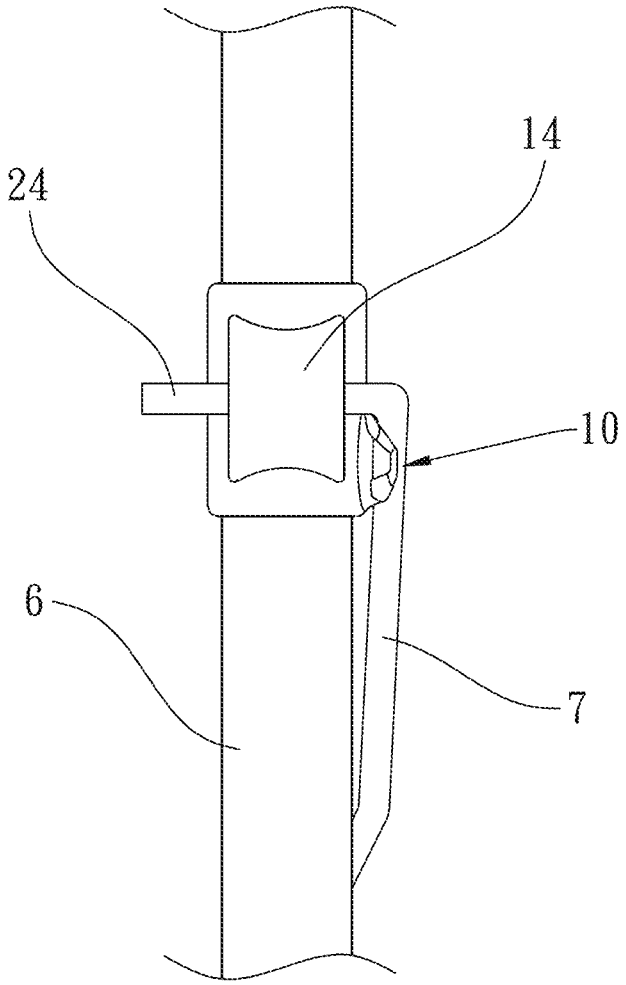
FIG. 5 is a partial front view of the support bars, elastic bars, and limiting members after the support bars have pivoted in relation to the elastic bars.
Figure 6:
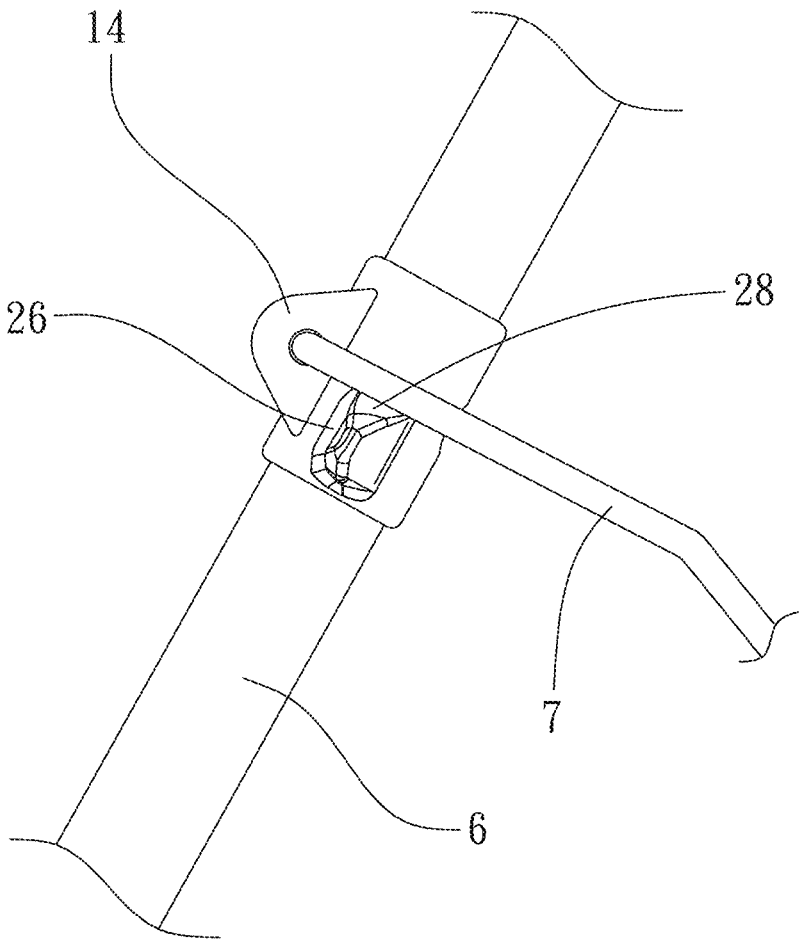
FIG. 6 is a partial side view of the support bars, elastic bars, and limiting members after the support bars have pivoted in relation to the elastic bars.

Moreover, to let the golf bag stand on the ground, the user just need to apply a force to pull the two support bars 6 outward, so that the two connecting blocks 9 can pivot in relation to the two elastic bars. Under the push by the two blocking planes 26, the two elastic bars 7 will gradually and relatively bend outward, and the bent segments 24 of the two elastic bars 4 will gradually move toward the outside of the through hole 22. When the two elastic bars 7 are bent to an extent that they are no longer blocked by the two blocking planes 26, as shown in FIG. 4, the two support bars 6 and the two elastic bars 7 can be released from the two limiting members 10 and can pivot in relation to each other. Thus, the two support bars 6 can stretch outward, as shown in FIG. 5 and FIG. 6, to prop up the golf bag on the ground.

To fold the two support bars 6, the user just need to push back the two support bars 6 toward the bag body 2, and the two connecting blocks 9 will pivot inversely in relation to the two elastic bars 4. The two elastic bars 4 will slide across the two guide planes 28 and move to one side of the blocking plane 26, and return to the state of limitation by the two limiting members 10.

In other words, the present invention further provides a method for limiting the two support bars 6 of a golf bag. It mainly provides a limiting means. The limiting means is used to limit the pivoting position of the two support bars 6 and the two elastic bars 7, so that, when the two support bars 6 are not pulled outward by a force, the two support bars 6 and the two elastic bars 7 cannot pivot in relation to each other. As described above, the limiting means uses limiting members 10 to be respectively configured at the pivoting positions of the two support bars 6 and the two elastic bars 7. Thus, through the two limiting members 10, when the two support bars 6 are not pulled outward by a force, the two support bars 6 and the two elastic bars 7 cannot pivot in relation to each other.

From the foregoing, it is known that the present invention of an improved golf bag supporting mechanism uses a limiting means where limiting members are respectively configured at the pivoting position of the two support bars and the two elastic bars to avoid the problem of that the two support bars will automatically stretch out when the bag body is filled with too many things.

It is to be understood that each of the blocking planes is not limited to the form disclosed above. It can be in any form as long as a balance is obtained between the capability to avoid automatic pivoting and outstretch of the two support bars in relation to the two elastic bars and the force required for the user to pull the two support bars outward.

Furthermore, each of the limiting members is not limited to the form disclosed above. It can be a clamp to clamp the elastic bars, or it can be an alternative form that the two limiting members are configured on the two elastic bars to limit the two support bars, as long as it can avoid automatic outstretch of the two support bars. All such forms are in conformity with the requirements of the invention and fall within the technical scope of the invention.

While the means of specific embodiments in the present invention have been described by reference drawings, numerous modifications and variations could be made thereto by those skilled in the art without departing from the scope and spirit of the invention set forth in the claims. The modifications and variations should be in a range limited by the specification of the present invention.

What is claimed is:

1. A golf bag with a supporting mechanism, said golf bag comprising a bag body having an upward opening, a head frame and a chassis respectively arranged at a top and a bottom end of the bag body, and a supporting mechanism arranged on one side of said bag body comprising two support bars and two elastic bars, one end of each of said two support bars pivoted on the head frame, two connecting blocks arranged on the two support bars, wherein said two elastic bars are relatively pivoted between the chassis and the two connecting blocks, and wherein said supporting mechanism further comprises two limiting members respectively configured at the two connecting blocks so as to limit a pivoting position of the two support bars relative to the two elastic bars, such that an outward force is required to pull said two support bars outward, so that said two support bars and said two elastic bars can be released from the two limiting members and be able to pivot in relation to each other.

2. The golf bag with supporting mechanism defined in claim 1, wherein said two connecting blocks are each configured with a through hole, the top of said two elastic bars can be movably inserted into two through holes, said two limiting members are configured on one side of two connecting blocks to correspond to the positions of the two elastic bars.

3. The golf bag with supporting mechanism defined in claim 2, wherein said two connecting blocks each respectively include a sleeve body and a pivoting block, each sleeve body is tubular in shape, respectively fits on a respective one of the two support bars, wherein said two pivoting blocks and two limiting members are respectively configured on an outside of a respective sleeve body in a protruding form, and wherein said two through holes are configured on two pivoting blocks.

4. The golf bag with supporting mechanism defined in claim 3, wherein the inner diameter of said two through hole are larger than the outer diameter of a top of the two elastic bars, said two limiting members correspond to one of each end of two elastic bars and are respectively configured with a blocking plane, said two elastic bars are configured against two blocking planes, so that two support bars cannot pivotally turn against two elastic bars.

5. The golf bag with supporting mechanism defined in claim 4, wherein one side of said two limiting members is configured with a guide plane, when said two support bars are closed, said two elastic bars move to one side of the blocking plane through the guide plane, and are resumed to a restraining state by two limiting members.

6. The golf bag with supporting mechanism defined in claim 5, wherein said two limiting members are in a pointed shape, each of said blocking planes and guide planes is extended to a surface of the limiting member in a tilted form.

7. The golf bag with supporting mechanism defined in claim 4, wherein the top of said two elastic bars is respectively bent to form a bent segment inserted into each of through holes, the bent segment of the top of each of said two elastic bars is located outside each of the through holes and corresponds to two blocking planes.

8. The golf bag with supporting mechanism defined in claim 7, wherein each of said bent segments is inserted into the end of each through hole correspondingly.

* * * * *